US005449307A

United States Patent [19]

Fuereder

[11] Patent Number: 5,449,307

[45] Date of Patent: Sep. 12, 1995

[54] SEA SURVEILLANCE AND CONTROL APPARATUS

[76] Inventor: Georg Fuereder, Dresdener Ring 5, 65191 Wiesbaden, Germany

[21] Appl. No.: 161,416

[22] Filed: Dec. 6, 1993

[30] Foreign Application Priority Data

Dec. 9, 1992 [DE] Germany ..... 42 41 445.8

[51] Int. Cl.[6] ..... B63B 22/06

[52] U.S. Cl. ..... 441/2; 441/28

[58] Field of Search ..... 89/1.11, 38; 102/406, 102/409, 410–412, 414, 416, 427; 446/154, 155, 153–155, 160–161, 165; 441/2, 21, 1, 3, 6, 32, 33, 23, 11, 29; 114/4, 15, 312, 316, 326, 328

[56] References Cited

U.S. PATENT DOCUMENTS

| | | | |
|---|---|---|---|
| 1,323,876 | 12/1919 | Lawson | 446/155 |
| 1,327,488 | 1/1920 | McNulty | 89/1.11 |
| 1,356,294 | 10/1920 | Kuhajda | 89/38 |
| 2,330,911 | 10/1943 | Petkoff | 114/19 |
| 2,354,758 | 8/1944 | Kotelev et al. | 114/4 |
| 2,355,918 | 8/1944 | Kotelev et al. | 114/316 |
| 2,903,822 | 9/1959 | Reid | 446/155 |
| 2,949,877 | 8/1960 | Newburn et al. | 114/20 |
| 3,178,736 | 4/1965 | Gross | 441/33 |
| 3,287,753 | 11/1966 | Race | 441/2 |
| 3,616,775 | 11/1971 | Holter | 114/54 |
| 5,154,016 | 10/1992 | Fedora et al. | 446/154 |

FOREIGN PATENT DOCUMENTS

| | | | |
|---|---|---|---|
| 2063890 | 7/1971 | France | B63G 8/00 |
| 2526383 | 1/1976 | Germany | B63G 8/38 |
| 3735705 | 4/1988 | Germany | B63G 8/38 |
| 9010980 | 12/1990 | Germany | B63G 8/38 |

OTHER PUBLICATIONS

Foxwell, Autonomous Underwater Vehicles–The Naval Force–Multiplier. International Defense Review Feb. '92.

Millne, Underwater Engineering Survey, 1980, London, pp. 275–277, 279–280, 283.

*Primary Examiner*—Edwin L. Swinehart

*Attorney, Agent, or Firm*—Veal & Marsh

[57] ABSTRACT

An apparatus and method for establishing and maintaining control over an area of the sea from a remote location, consisting of a remote control point, a number of submersible satellite stations and means for communicating by radio or conductive cable between the control point and each station. Each battery-powered satellite station includes either a flotation chamber or airbag and a stabilizing chamber. The stabilizing chamber is equipped with pumps for intake and discharge of water, allowing adjustment of the buoyancy of each satellite station. Detection devices, such as infrared or acoustical sensors, and weapons systems, such as missiles, are mounted on a platform affixed to a mast on top of each station. The remote control point is equipped with a programmable logic system, which converts data received from the satellite stations and graphically depicts it on computer screens, providing real-time input for combat command decisions.

28 Claims, 6 Drawing Sheets

SEA SURVEILLANCE AND CONTROL APPARATUS

FIELD OF THE INVENTION

The present invention relates to maritime control. More particularly, the present invention relates to the control of specific areas of the sea. In even greater particularity, the present invention relates to surveillance and weapons systems which can be used to establish control over an area of the sea. Still more particularly, the present invention relates to unmanned sea surveillance and combat stations which are characterized by the capability to adjust the buoyancy of each station and command the surveillance and combat functions from a remote control point.

BACKGROUND OF THE INVENTION

Unmanned floating buoys are presently known in the art of sea reconnaissance. These buoys are equipped with suitable sensors such as sonars and are used for detecting the presence and movement of ships and submarines. The analysis of the signals received from the buoys allows determination of the type, speed and direction of the ship that has been detected. The use of data from several floating buoys increases the accuracy of the analysis.

Other known unmanned combat systems for deployment in the sea are sea mines, which are either anchored or allowed to float freely. These mines may be activated automatically through timers, or remotely, by way of radio link or ultra-sound. The mines may also be detonated either automatically or remotely. Automatic detonation is effected by suitable sensors such as contact-devices, magnetic detectors or acoustical detectors. An inherent disadvantage of ordinary sea mines is that they cannot positively identify a target before detonation. They accordingly represent a danger to friendly as well as enemy vessels.

SUMMARY OF THE PRESENT INVENTION

With the foregoing in mind, the principal object of the present invention is to provide a remotely controllable system of unmanned sea stations which are capable of correctly identifying and subsequently combating targets.

Another object of the invention is to increase the survivability of deployed detection and combat devices by providing a sea surveillance and combat system which is more difficult to detect and disable than traditional sea buoys.

Yet another object of the invention is to provide a system that can be deactivated from a remote location, thereby decreasing the risk of inadvertently targeting a friendly vessel.

These and other objects of the present invention are accomplished through the use of a number of modular floating stations which can be positioned at varying sea depths, and which are controlled from a central remote control point. The modular floating stations may be equipped with a variety of detection and combat devices, depending on the specific purpose of the particular deployment. The detection devices may be infrared sensors, radar sensors, sonar sensors, acoustic sensors, and visionics. The combat devices may be weapons of any variety, including rockets and cruise missiles. The modular stations are further equipped to communicate with a control station at a remote location, either through radio transmissions or through a conductive cable. The control point may be either stationary, semi-stationary, or mobile. Equipping a submarine to serve as the remote control point enhances the flexibility of the system. If the control point is stationary, the satellite stations must be either stationary or semi-stationary. If the control point is semi-stationary or mobile, the satellite stations may also be semi-stationary or mobile.

Although a single station in communication with a remote control point could be used, the present invention is most effective if a plurality of stations are used to increase the reliability of the analysis of the signals received at the remote control point from each of the stations. The preferred system includes an operator at a remote central control point in communication with a plurality of satellite stations.

BRIEF DESCRIPTION OF THE DRAWINGS

The foregoing objects and advantages of the present invention for an apparatus for establishing and maintaining control over an area of the sea from a remote location will be more readily understood by one skilled in the art by referring to the following detailed description of a preferred embodiment and to the accompanying drawings which form a part of this disclosure, and wherein.

DETAILED DESCRIPTION OF THE INVENTION

Figure 1:
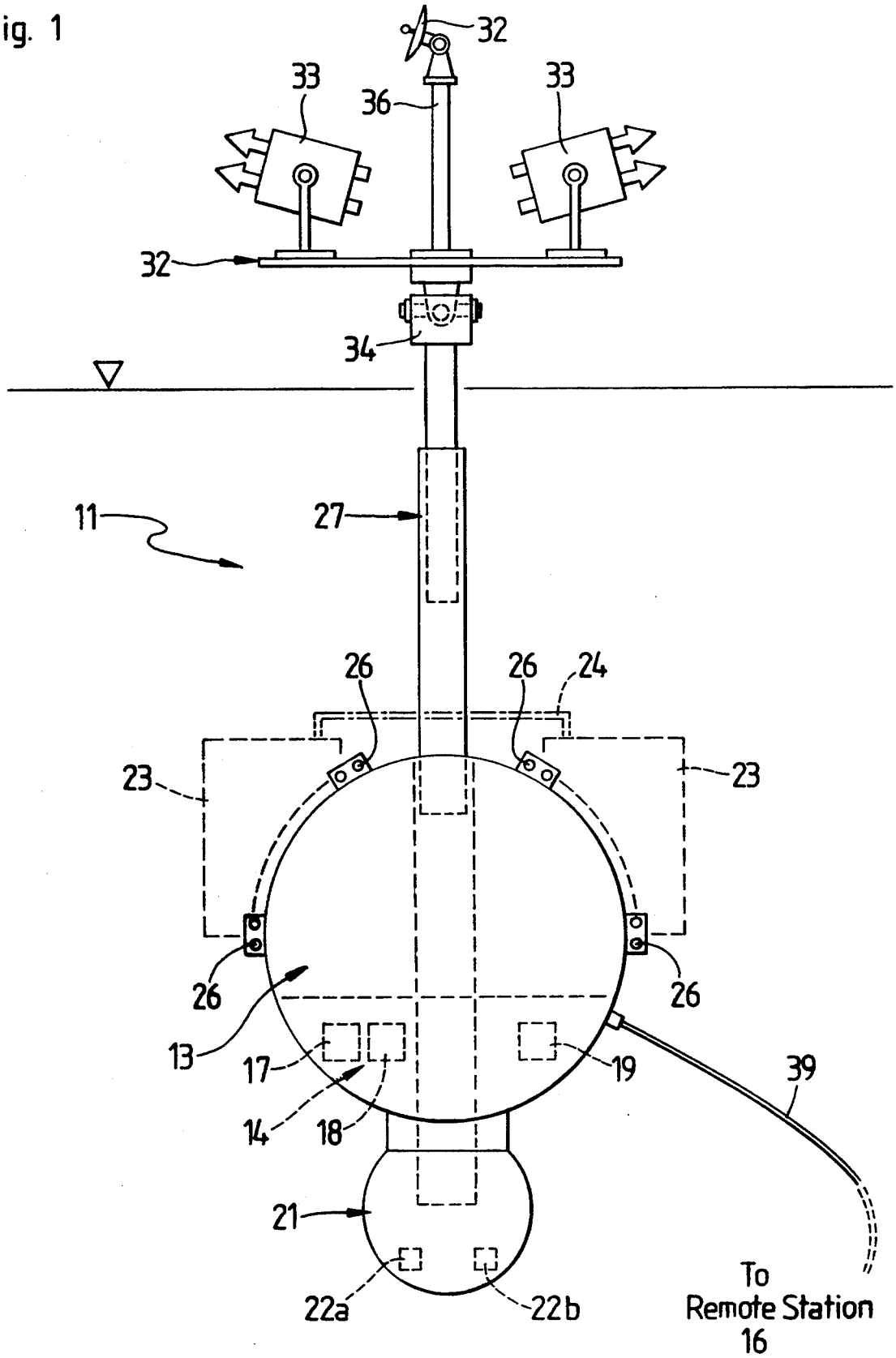
FIG. 1 is a cross-sectional view of an embodiment of the present invention, showing the spherical flotation chamber and depicting the components of a satellite station.
Figure 2:
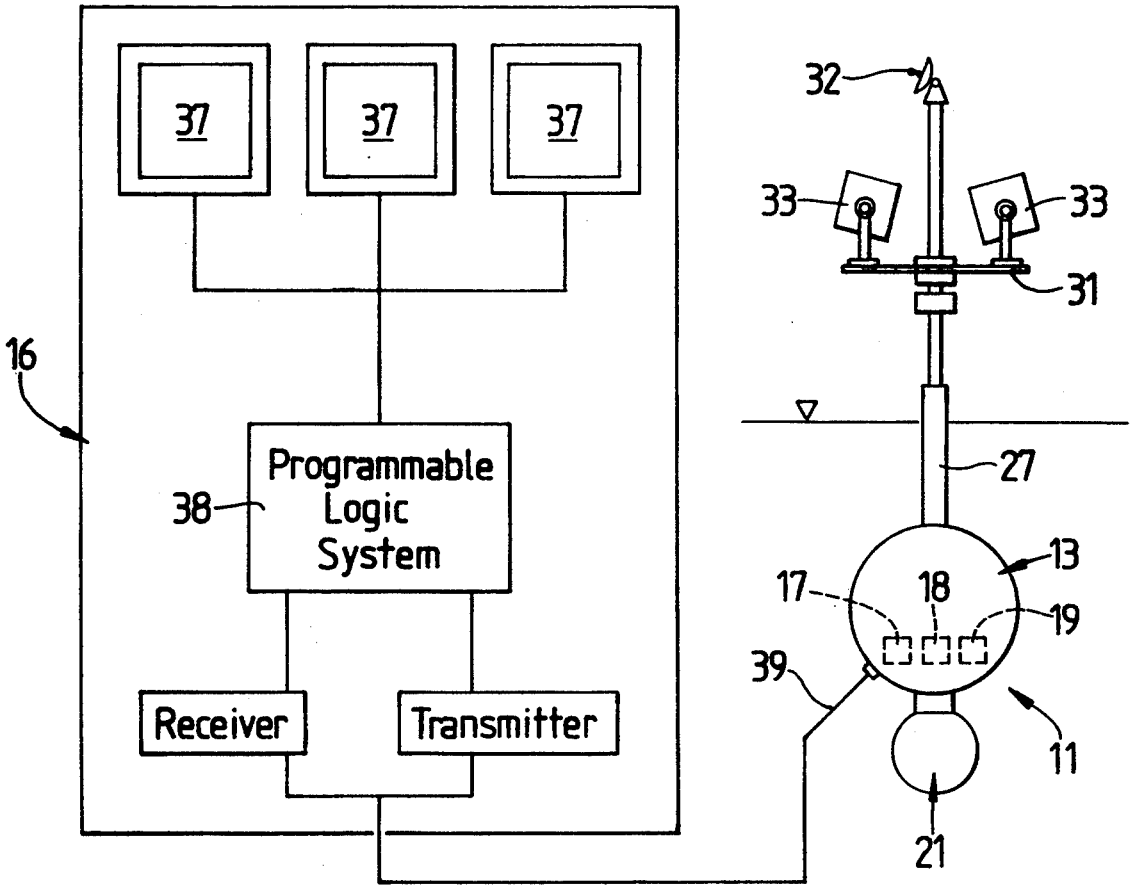
FIG. 2 is a schematic representation of the remote control point.
Figure 4:
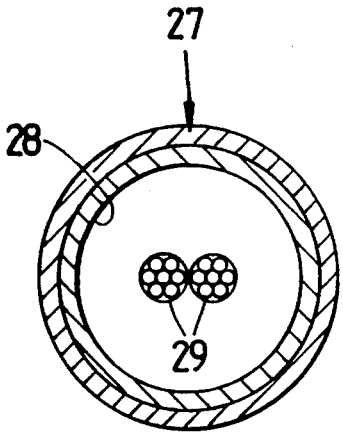
FIG. 4 is a cross-sectional view of the mast, showing the air duct and cable within the mast.
Figure 3:
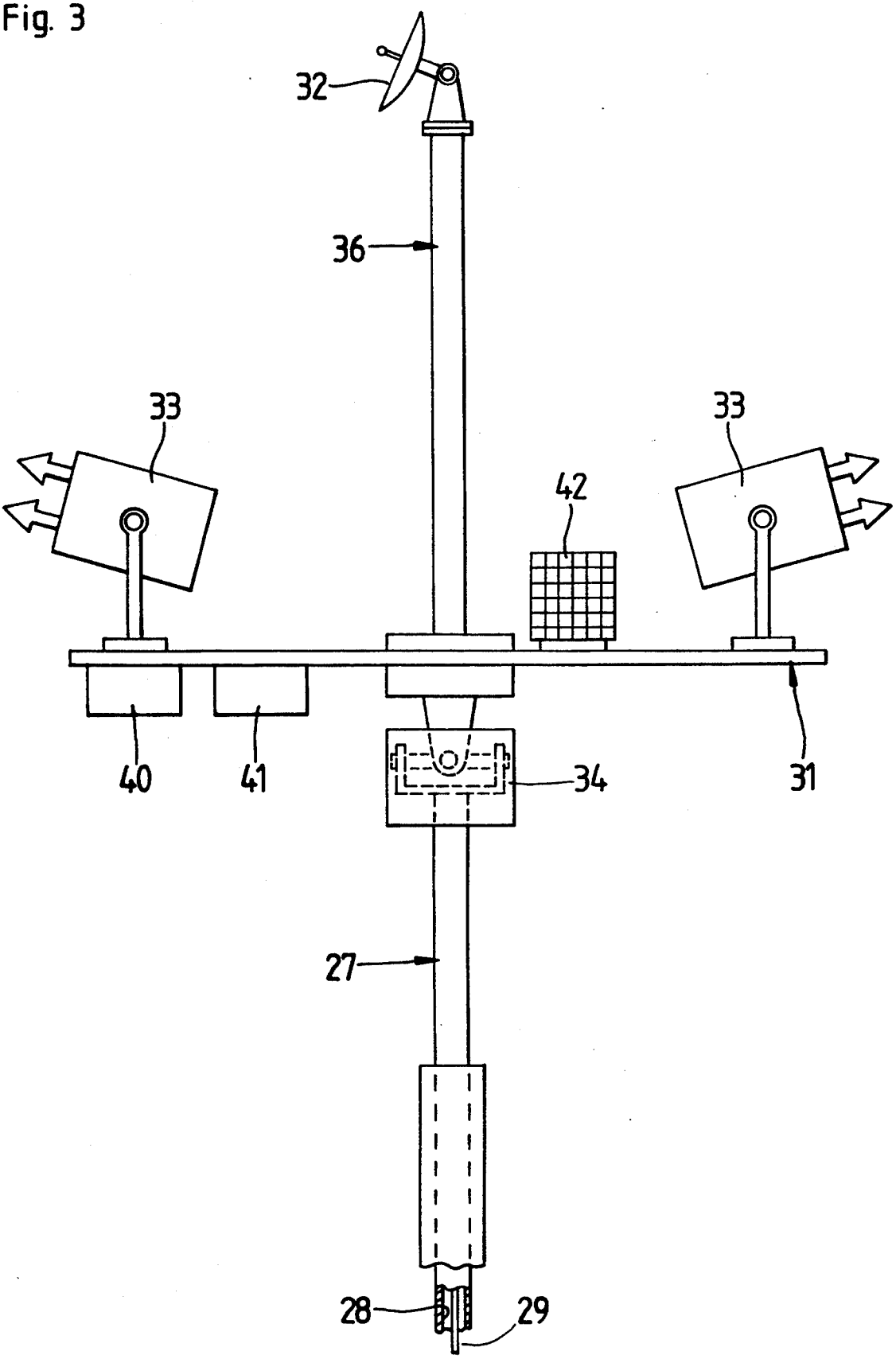
FIG. 3 is an enlarged side elevational view of the mast and platform of the satellite station, depicting the components which may be mounted upon the platform.

As may be seen in FIGS. 1 and 2, the present invention utilizes a plurality of satellite stations 11, each of which may be anchored by a cable 12 to provide a stationary or nearly stationary platform. The buoyancy of each station 11 is adjustable, so that each may independently be positioned at various sea-depths as required by the circumstances. In the preferred embodiment, each station 11 includes a flotation chamber 13 which is watertight, and is used to house equipment 14 necessary for communicating with a remote control point This would include a receiver 17 and transmitter 18 for electronic signals, as well as the necessary programmable hardware 19 for translating the electronic signals into executable commands and for executing those commands to control various other components of the invention. Attached below the flotation chamber 13 is a stabilizing chamber which includes at least one pump 22 for intake and discharge of water into and out of the stabilizing chamber. As shown, the preferred embodiment contains two pumps 22*a* and 22*b*. When the stabilizing chamber 21 is filled with water, the station descends, due to gravitational forces. When water is expelled from the stabilizing chamber, the station ascends. To provide additional lift, auxiliary flotation chambers 23 may be attached to the primary flotation chamber 13 in such a position as to provide upward force. These auxiliary flotation chambers are connected by pressure equalizing lines 24 providing fluid communication between the auxiliary flotation chambers. A number of eyelets 26 are attached to the exterior of the primary flotation chamber 13, so that auxiliary devices such as crane hooks, collapsible auxiliary flotation chambers, compressed air bottles or a connecting cable may be attached to the station 11. Additional load-carrying flotation chambers 20 that can accommodate weapons, operating supplies or maintenance supplies may also be attached to station 11 using the eyelets A mast 27 is attached to the primary flotation chamber 13. The mast may either be extendable and retractable or may be of a fixed length. In the preferred embodiment, a telescoping mast is shown. As shown, the mast defines a central duct 28, which may be used to aspirate air from above the surface. Air aspirated through the duct may be compressed into compressed air bottles, or used to provide an emergency air supply to the remote control point, provided that the station is connected to the control point by means of a connecting cable which also incorporates an air duct. A communications or power cable 29 may also be positioned within the duct 28.

Attached to the end of the mast opposite the flotation chamber is a platform 31, upon which sensors 32 and combat weapons 33 may be mounted. The platform is preferably self-stabilizing in both vertical and horizontal planes. A gyroscope system 34 could be used for this purpose. The platform 31 is configured for optional attachment of either sensors or weapons, or both. If the purpose of the deployment is only for surveillance and reconnaissance, for example, sensors only would be mounted on the platform. The use of the telescoping or extendable mast enhances the rapid deployment of the sensors and weapons, since the system then need not rely on buoyancy changes alone for positioning the platform. The use of a mast, either fixed-length or extendable, has the additional advantage of reducing the possibility of detection by enemy reconnaissance, as the above-water portion of the station which holds the surveillance or combat weapons system presents a very small target. The target size may be even further reduced if the combat weapon systems and the surveillance equipment are themselves mounted on a second mast 36 affixed to the platform.

As seen in FIG. 2, the remote deployment of the stations is directed from the remote control point 16 based upon data collected by the sensors. The data is received via receiver/transmitter devices 17 and 18 from the stations and is integrated and graphically depicted on computer screens 37 at the remote control point by a programmable logic system 38, providing real-time input for command combat decisions. The weapons systems on the platform are activated or launched by command from the central control point. To increase flexibility, override and abort functions are incorporated into the control systems logic, allowing for immediate deactivation of the weapons systems from the remote control point, if necessary.

Alternatively, stations can be equipped for autonomous deployment with pre-programmed target identification and appropriate weapons release systems, incorporated in programmable hardware 19.

Information is communicated between the stations and the control point by either radio link or conductive cable 39. In the event a connecting conductive cable is used, it may be used to transmit electrical energy between the control point and the satellite stations, as well as for data transmission.

Energy is supplied to the station by means of rechargeable batteries 41 mounted on the platform 31 or within the primary flotation chamber 13. The batteries 41 may alternatively be recharged through a conductive conduit 39 from the control point to the satellite station, or through the use of generating equipment 40, mounted on the platform or within the primary flotation chamber, and either a fuel cell containing an expendable fuel or a solar cell 42, attached to platform 31.

Figure 5:
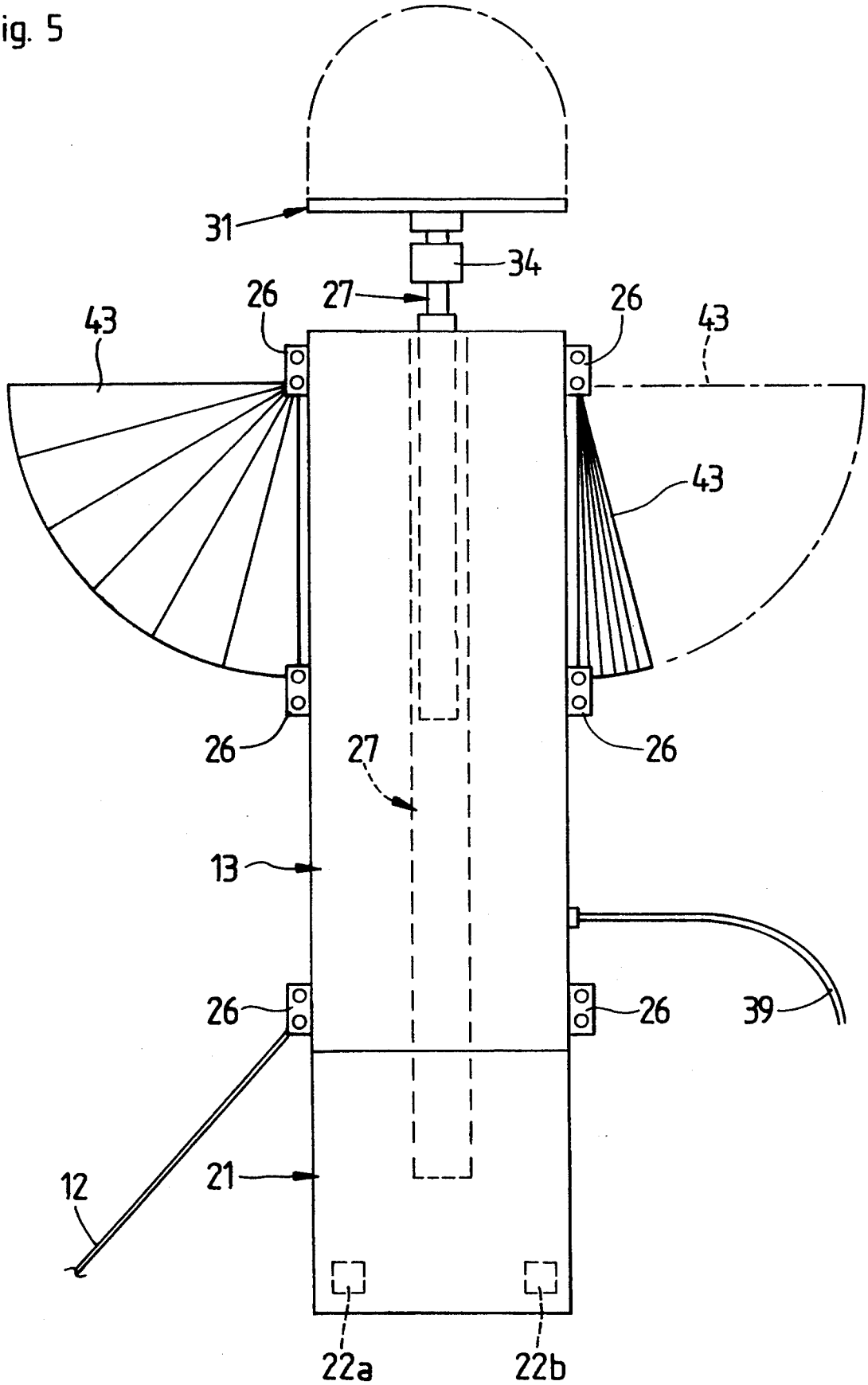
FIG. 5 is a side-elevational view of a second embodiment of the present invention, showing the cylindrical flotation chamber.

A second embodiment of the invention, shown in FIG. 5 has a primary flotation chamber that is cylindrical in shape, rather than spherical. The advantage offered by this embodiment is that it may be easily stored or transported, either above or below water. The station may be transported in the horizontal position. Once the deployment area is reached, the stabilization chamber 21 may be flooded to position the station vertically. Large collapsible auxiliary flotation chambers 43 attached to the primary flotation chamber provide increased load-carrying capacity to accommodate, for example, underwater sensors or torpedoes. Each auxiliary flotation chamber is equipped with inlet and outlet valves which may be controlled from the remote control point.

Figure 6:
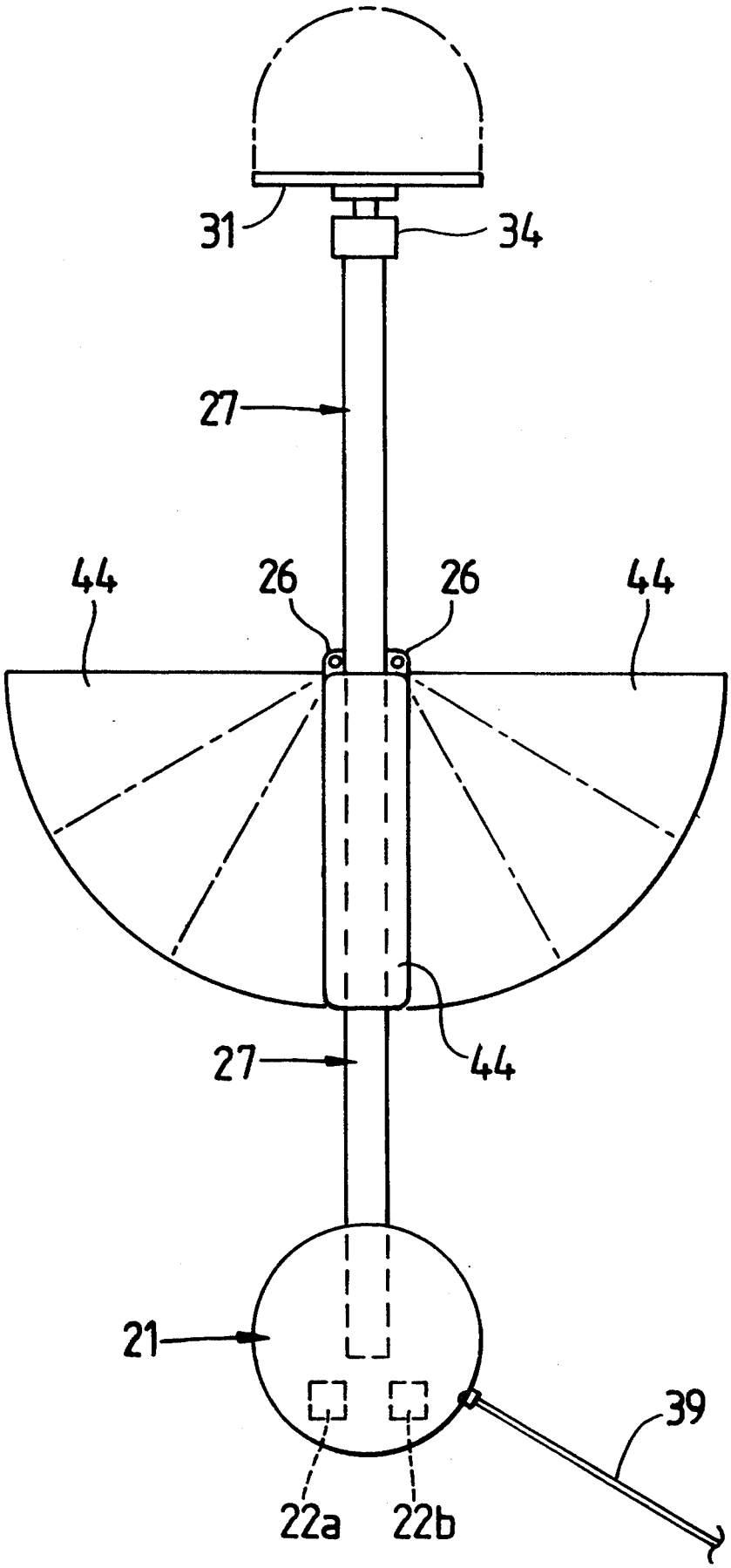
FIG. 6 is a side-elevational view of a third embodiment of the present invention, showing the use of air-bags attached to the mast for flotation.
Figure 7:
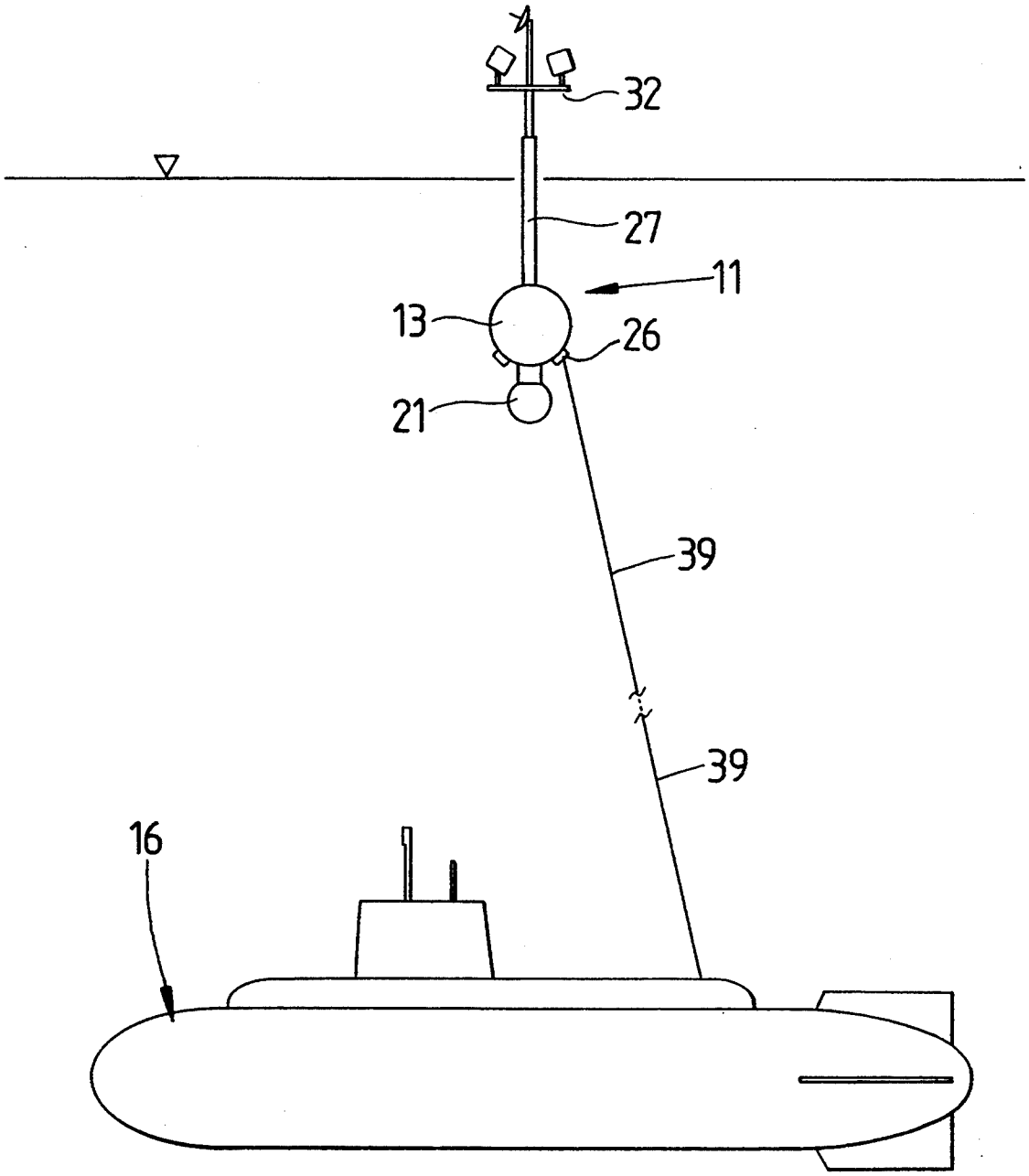
FIG. 7 is a side-elevational view of the present invention, showing the use of a submarine as the remote control point.

A third embodiment of the invention provides a lightweight, low-cost option, as shown in FIG. 6. In this embodiment, the primary flotation chamber consists of one or more airbags 44 attached to the mast 27. The buoyancy of the station is adjusted through use of inlet valves 46 and outlet valves 47 in the airbag(s) 44.

While I have shown my invention in several forms, it will be obvious to those skilled in the art that it is not so limited but is susceptible of various changes and modifications without departing from the spirit thereof.

Having set forth the nature of the invention, what is claimed is:

1. An apparatus for establishing and maintaining control over an area of the sea from a remote location, comprising in combination:

(a) a plurality of discrete submersible stations, detachably affixed at selected locations within said area of the sea, each of said pluralities of stations having independently controllable means for adjusting the buoyancy thereof and separable and independently controllable means for controlling a discrete area;

(b) a remote control point; and (c) means for communicating between each of said plurality of stations and said remote control point.

2. An apparatus for establishing and maintaining control over an area of the sea from a remote location as defined in claim 1, further comprising:

(a) a mast, supported by said station; and (b) a platform, attached to an upper end of said mast, for mounting of said area-controlling means.

3. An apparatus for establishing and maintaining control over an area of the sea from a remote location as defined in claim 2, wherein said mast is an extendable mast, which may be selectively moved to a plurality of positions intermediate a fully extended position and a retracted position.

4. An apparatus for establishing and maintaining control over an area of the sea from a remote location as defined in claim 2, wherein said mast further supports a duct, such that air may be aspirated through said duct and such that a communications or power cable may be run from said platform through said duct.

5. An apparatus for establishing and maintaining control over an area of the sea from a remote location as defined in claim 2 wherein said buoyancy-adjusting means comprises:

(a) a flotation chamber; and (b) a stabilizing chamber attached below said flotation chamber, said stabilizing chamber including at least one pump for intake and discharge of water into and out of said stabilizing chamber.

6. An apparatus for establishing and maintaining control over an area of the sea from a remote location as defined in claim 5, wherein said flotation chamber is spherical in shape.

7. An apparatus for establishing and maintaining control over an area of the sea from a remote location as defined in claim 5, wherein said flotation chamber is cylindrical in shape.

8. An apparatus for establishing and maintaining control over an area of the sea from a remote location as defined in claim 5, wherein said buoyancy-adjusting means further comprises an auxiliary flotation chamber attached to said flotation chamber in position to provide upward force in cooperation with said stabilizing chamber.

9. An apparatus for establishing and maintaining control over an area of the sea from a remote location as defined in claim 8, wherein said buoyancy-adjusting means further comprises:

(a) a plurality of collapsible auxiliary flotation chambers, removably attached to said flotation chamber opposite said stabilizing chamber; and (b) pressure equalizing lines providing fluid communication between said auxiliary flotation chambers, such that said mast may be maintained in an upright position.

10. An apparatus for establishing and maintaining control over an area of the sea from a remote location as defined in claim 2, wherein said buoyancy-adjusting means comprises:

(a) at least one airbag, having an inlet valve and an outlet valve for selective inflation and deflation of said airbag; and (b) a stabilizing chamber attached below said flotation chamber, said stabilizing chamber including at least one pump for intake and discharge of water into and out of said stabilizing chamber.

11. An apparatus for establishing and maintaining control over an area of the sea from a remote location as defined in claim 1, wherein said communicating means comprises:

(a) means for receiving electronic signals;

(b) means for transmitting electronic signals; and (c) programmable means for executing commands received from said receiving means and generating signals to be sent by said transmitting means, further comprising interface means for controlling said mast and said buoyancy adjusting means.

12. An apparatus for establishing and maintaining control over an area of the sea from a remote location as defined in claim 11, wherein said signals are carried by radio waves.

13. An apparatus for establishing and maintaining control over an area of the sea from a remote location as defined in claim 11, wherein said signals are carried via a conductor.

14. An apparatus for establishing and maintaining control over an area of the sea from a remote location as defined in claim 2, further comprising means for automatically stabilizing said platform along both vertical and horizontal planes.

15. An apparatus for establishing and maintaining control over an area of the sea from a remote location as defined in claim 1, wherein said area-controlling means further comprises sensors for conducting surveillance and reconnaissance of said area of the sea, said sensors selected from the class of sensors including infrared sensors, radar sensors, sonar sensors, acoustic sensors and visionics.

16. An apparatus for establishing and maintaining control over an area of the sea from a remote location as defined in claim 1, wherein said area-controlling means further comprises weapons systems for conducting combat within said area of the sea.

17. An apparatus for establishing and maintaining control over an area of the sea from a remote location as defined in claim 1, wherein said remote control point comprises a submarine.

18. An apparatus for establishing and maintaining control over an area of the sea from a remote location as defined in claim 5, further comprising means for supplying energy to said station.

19. An apparatus for establishing and maintaining control over an area of the sea from a remote location as defined in claim 18, wherein said energy supplying means comprises a conduit connecting said station to said remote control point, said conduit providing for the electrical communication between said station and said remote control point.

20. An apparatus for establishing and maintaining control over an area of the sea from a remote location as defined in claim 18, wherein said energy supply means further comprises a rechargeable battery.

21. An apparatus for establishing and maintaining control over an area of the sea from a remote location as defined in claim 18, wherein said energy supply means further comprises a solar cell.

22. An apparatus for establishing and maintaining control over an area of the sea from a remote location as defined in claim 18, wherein said energy supply means further comprises a fuel cell, containing an expendable fuel.

23. An apparatus for establishing and maintaining control over an area of the sea from a remote location as defined in claim 18, wherein said energy supply means further comprises a generator.

24. An apparatus for establishing and maintaining control over an area of the sea from a remote location as defined in claim 5, further comprising at least one eyelet rigidly attached to the exterior surface of said flotation chamber, such that an auxiliary device may be attached thereto.

25. A method for establishing and maintaining control over an area of the sea from a remote location, comprising:

(a) deploying a plurality of discrete submersible stations to selected locations within said area of the sea, said stations each having independently controllable means for adjusting the buoyancy thereof to cause vertical movement of said stations in either an upward or downward direction and separable and independently controllable means for controlling a discrete area; and (b) communicating with at least one of said submersible stations from a remote control point by transmitting electronic signals between said remote control point and said buoyancy-adjusting means, said signals directing the ascent or descent of said station, and by transmitting electronic signals between said remote control point and said area-controlling means.

26. A method for establishing and maintaining control over an area of the sea from a remote location as defined in claim 25, further comprising using an operator at said remote control point to interpret data received from said submersible station and to determine appropriate commands to transmit to said station.

27. A method for establishing and maintaining control over an area of the sea from a remote location as defined in claim 25, further comprising sensing visual, acoustic, radar, sonar, and infrared data at said submersible stations with sensors capable of receiving said data and communicating said data to said remote control point.

28. A method for establishing and maintaining control over an area of the sea from a remote location as defined in claim 25, further comprising deploying weapons from said submersible stations.

* * * * *